US006701983B1

(12) United States Patent
Koike

(10) Patent No.: US 6,701,983 B1
(45) Date of Patent: Mar. 9, 2004

(54) PERIPHERALLY DRIVEN VENEER LATHE

(75) Inventor: Masaru Koike, Aichi (JP)

(73) Assignee: Meinan Machinery Works, Inc., Obu (JP)

( * ) Notice: Subject to any disclaimer, the term of this patent is extended or adjusted under 35 U.S.C. 154(b) by 0 days.

(21) Appl. No.: 10/244,017

(22) Filed: Sep. 16, 2002

(51) Int. Cl.[7] ..... B27L 5/02
(52) U.S. Cl. ..... 144/213; 144/209.1; 144/365
(58) Field of Search ..... 144/209.1, 211, 144/212, 213, 365

(56) References Cited

U.S. PATENT DOCUMENTS 4,269,243 A * 5/1981 Hasegawa ..... 144/213
5,630,454 A * 5/1997 Koike ..... 144/212
5,787,949 A * 8/1998 Koike et al. ..... 144/213

* cited by examiner

*Primary Examiner*—W. Donald Bray
(74) *Attorney, Agent, or Firm*—Westerman, Hattori, Daniels & Adrian, LLP

(57) ABSTRACT

A peripherally driven veneer lathe employs a knife with an improved shape which increases the deflection resistance of the cutting edge and improves its cutting ability. A cutting edge (7*c*) is positioned on the flank side a predetermined distance (H) away from a point (X) of intersection of an extended plane of a cutting face (7*a*) and that of a flank (7*b*) of a knife (7) toward the downstream of the rotation of a log. The cutting face immediately following the cutting edge (7*c*) is formed as a connecting curved surface (7*d*) coinciding with a concentric arc distanced from the trajectory (G) of rotation of piercing projections (4*a*) of a peripheral-drive member (4) with a predetermined gap (S). Preferably, the angle (α) formed by a line (D) tangent to the connecting curved surface (7*d*) at the cutting edge and the flank (7*b*) is roughly equal to the sharpness angle (β: 18° to 25°) of the conventional knife.

6 Claims, 13 Drawing Sheets

PERIPHERALLY DRIVEN VENEER LATHE

BACKGROUND OF THE INVENTION

1. Field of the Invention

The present invention relates to a peripherally driven veneer lathe and an improvement of a knife used therefor.

2. Prior Art

Recent years have witnessed so-called peripherally driven veneer lathes becoming the mainstream in the field of veneer lathes. The peripherally driven veneer lathe is designed such that at least part of the power required for peeling a log is supplied through the periphery of the log. Examples of this type of lathe are disclosed in, e.g., Japanese Patent Examined Publication (Kokoku) No. 59-28444, Japanese Registered Utility Model No. 2539258, Japanese Patent Examined Publication (Kokoku) No. 61-21808, and U.S. Pat. No. 6,357,496. The veneer lathe of this type comprises a peripheral-drive member having a plurality of drive members disposed at proper intervals along the axis, each drive member having on its periphery a number of piercing projections. The peripheral-drive member is disposed such that the piercing projections can pierce the periphery of the log immediately before the cutting edge of the knife. Thus, this type of lathe can transmit motive power to the log via the piercing projections in an extremely stable manner, resulting in its very wide use.

The peripherally driven veneer lathe of the above-described type will now be described by referring to an actual example shown in the drawings. As shown in FIG. 8 and FIG. 9, the latter being an enlarged view of a portion indicated by a circle B in FIG. 8, the peripherally driven veneer lathe comprises a knife 2, a knife carriage 1, a peripheral-drive member 4, and a spindle 3 for supporting a log 5. The knife 2 comprises a cutting face 2*a* and a flank 2*b* and is mounted on the knife carriage such that the flank is opposite the log. The peripheral-drive member 4 comprises a plurality of drive members 4*b* disposed at proper intervals along the axis, each drive member 4*b* being disposed substantially parallel to a cutting edge 2*c* of the knife 2 and having a number of piercing projections 4*a* on the periphery. Normally, the peripheral-drive member 4 is disposed at such a position that the piercing projections 4*a* can pierce the periphery of the log immediately before the cutting edge 2*c* of the knife 2, which is mounted on the knife carriage 1 via a knife clamp 1*a*. A veneer 6 is produced by providing at least part of the motive power necessary for peeling the log 5, held by a spindle 3, from the peripheral-drive member 4. This manner of supplying the power makes it possible to peel both an unusually hard and an unusually soft log with ease, which was very difficult for the conventional spindle-driven veneer lathes.

An improved example in practical use will be described by referring to FIG. 11 and FIG. 12, the latter showing an enlarged view of a portion of FIG. 11 indicated by a circle C. In this example, the function of the piercing projections 4*a* is secondarily exploited. As shown, in addition to the features of the above-described example, this example includes a guide member 8 having a guide surface 8*a* mounted at the tip of the knife carriage 1. The guide surface 8*a* substantially coincides with a part of a circle (to be hereafter referred to as a concentric arc) concentric with a rotation trajectory G of the piercing projections 4*a* but with a larger radius and therefore away from the rotation trajectory G by a predetermined distance. This example further includes a bending member 9 disposed between adjacent drive members 4*b*, by which the veneer 6 is forcibly bent toward the back side, thereby creating many surface cracks starting from the points pierced by the piercing projections 4*a* and providing the veneer 6 with flexibility. Another improved example (not shown) in practical use includes, in addition to the features of the above example, backup rolls for holding the periphery of the log from at least two directions, so that the log can be released from the spindle in the final stage of peeling and peeled until it becomes thinner than the spindle.

In this type of veneer lathe, the peripheral-drive member 4 is disposed such that the piercing projections 4*a* can pierce the periphery of the log immediately before the cutting edge 2*a* of the knife 2 mainly because at this position, a preferable engagement can be obtained between the piercing projections 4 a of the peripheral-drive member 4 and the log 5. Specifically, in order to prevent the piercing projections 4*a* and the knife 2 from colliding with and damaging each other due to vibrations and the like of the peripheral-drive member 4, the peripheral-drive member 4 must be disposed in such a manner as to ensure a gap S (see FIGS. 9 and 12) of more than a certain limit (generally, about 1 mm) between the rotational trajectory G of the piercing projections 4*a* and the knife 2 when the knife 2 and the peripheral-drive member 4 are most closely located (the peripheral-drive member may be fixedly secured to the knife carriage 1, or it may be movably mounted thereon, as disclosed in the above-mentioned Japanese Registered Utility Model No. 2539258 or Japanese Patent Examined Publication (Kokoku) No. 61-21808). Also, the depth of piercing on the log 5 by the piercing projections 4*a* must be correspondingly controlled. Under these restrictions, the above position is preferable if the piercing projections 4*a* and the log 5 are to be satisfactorily engaged with each other as the log 5 is peeled and becomes smaller in diameter, as shown by the broken line in FIGS. 8 and 9. Another reason why the above position is selected is that positioning the peripheral-drive member 4 there enables the piercing projections 4*a* to pierce the veneer 6 as well, which facilitates the smooth delivery of the veneer 6.

In other words, in order to obtain a satisfactory engagement between the piercing projections of the peripheral-drive member and the log, it is effective to set the position of the peripheral-drive member 4 such that an axis 4*d* of an axle 4*c* of the peripheral-drive member 4 is located on or near a line perpendicular to the cutting face 2*a* and passing at the cutting edge 2*c* of the knife 2 (the line passing at the edge of the knife and normal to the cutting face), as shown in FIGS. 8 and 11. While not shown, when the peripheral-drive member is movably mounted, too, as disclosed in the above-mentioned Japanese Registered Utility Model No. 2539258 or Japanese Patent Examined Publication (Kokoku) No. 61-21808, the peripheral-drive member is preferably positioned at the position as described above when the knife and the peripheral-drive member are most closely located with each other.

If the peripheral-drive member is disposed at a higher position than the above position, the piercing projections can be located further away from the knife and thus a collision can be reliably avoided and the piercing projections can more deeply pierce the log. However, in this case, the position at which the motive power is supplied will be further away from the cutting edge of the knife, and this creates a problem in the driving of the log. For example, if a part of the log is missing or the periphery of a non-cylindrical log is to be peeled, or if the log is to be peeled down to an extremely small diameter, it becomes difficult to perform peeling at the end portion of the veneer, i.e., the end portion may remain uncut and get stuck on the knife, thereby causing the veneer to be torn at an arbitrary, undesirable location, such as one on the extension of a crack (formed in the log) that already exists on the veneer.

In the above-described peripherally driven veneer lathe, the shape of the knife and the manner in which it is mounted on the knife carriage are the same as in the conventional spindle-driven veneer lathe. In the conventional example, as shown in FIG. 11, the knife 2 includes two parallel surfaces 2*a* and 2*d,* and a surface 2*b* which connects the two surfaces 2*a* and 2*d* in an inclined manner and which, together with the surface 2*a,* forms the cutting edge 2*c*. From the viewpoint of ease of replacement of the knife, reliability (stability) with which the knife is held, and so on, the knife 2 is mounted such that the surface 2*b* is opposite the log 5 and forms a flank, while the surface 2*a* forms a cutting face, as shown. Further, as shown in FIG. 12, a sharpness angle β formed by the flank 2*b* and the cutting face 2*a* is set at a desired value (normally, in the range of from 18° to 25°). If necessary, in order to improve, e.g., the wear resistance of the cutting edge, a microscopic portion of the cutting edge 2*c* (mainly a portion on the flank side extending from about 200 μm to about 700 μm) is finish-ground with one or more angles which are somewhat larger than the sharpness angle β, before the knife is mounted on the knife carriage 1 with a required angle of relief γ (normally, from 30' to 1°) relative to a vertical line Y extending from the cutting edge 2*c*.

The sharpness angle β is closely related to the performance of a knife. A decrease in the sharpness angle β increases the cutting ability of the knife but undermines its deflection resistance. Conversely, an increase in the sharpness angle enhances the deflection resistance but weakens the cutting ability. At any rate, since the deflection resistance of a knife with the above shape is restricted to be below a limit corresponding to the sharpness angle β, the deflection resistance of the knife in the conventional machines has not always been good enough, resulting, for example, in the cutting edge portion (including the cutting edge 2*c* and a portion near it) being deflected in the course of peeling the log, as indicated by the dotted line in FIGS. 10 and 13 (the deflection occurs mainly toward the cutting face; but it may be toward the flank). As a result, the thickness of the produced veneers may vary, or the peeled surface of the veneer becomes coarse, for example. Moreover, once the cutting edge portion is deflected, a hard log tends to gradually increase the deflection, making, in a worst case, it impossible to continue the peeling operation.

It should be noted that even if the guide member 8 is provided as shown in FIGS. 11 and 12, if the edge of the guide member 8 is extended to the vicinity of the cutting edge 2*c* of the knife 2, the edge portion has to be made extremely thin. This makes it liable that, if the cutting edge portion of the knife is deflected away from the log even once, distortion remains in the edge portion of the guide member, which is deflected along with the cutting edge portion. Should even a hint of distortion remain there, the delivery of subsequent veneers will be hindered. Therefore, the edge of the guide member 8 has to be provided with a step and positioned significantly away from the cutting edge of the knife after all, as shown in the drawings. This means that the guide member 8 can hardly be expected to provide the function of preventing the deflection of the cutting edge portion of the knife. Furthermore, if the guide member is provided with a step, the direction of delivery of the veneer changes suddenly near the tip of the guide member, thereby hindering a smooth delivery of the veneer.

SUMMARY OF THE INVENTION

The present invention has been made with a view to overcoming the defects of the conventional peripherally driven veneer lathe. It is therefore an object of the present invention to enhance the deflection resistance of the cutting edge portion and improve its cutting ability by improving the shape of the cutting edge portion of the knife mounted on the knife carriage, while maintaining the positional relationships among the constituent members or elements as known in the art, so as not to adversely affect the log-driving function, the cutting ability and so on.

In accordance with the present invention, in the peripherally driven veneer lathe of the known type as described above, the cutting edge of the knife is positioned on the flank side a desired distance away from a point of intersection of an extended plane of the cutting face and an extended plane of the flank, toward the downstream of the rotation of the log, wherein the cutting edge and the cutting face are connected by a connecting curved surface. Further, the knife is mounted on the knife carriage such that the connecting curved surface is positioned away from the trajectory of rotation of piercing projections formed on a peripheral-drive member with a predetermined gap when the peripheral drive member is most closely positioned to the knife.

Preferably, the connecting curved surface of the knife mounted on the knife carriage is formed such that the angle formed by a line tangent to the connecting curved surface at the cutting edge and the flank is roughly the same as the angle of intersection of the extended plane of the cutting face and the extended plane of the flank. Preferably, the angle formed by the line tangent to the connecting curved surface at the cutting edge and the flank is in the range of from 18° to 25°.

The curved surface of the knife may comprise a second curved surface closer to the cutting edge and a first curved surface that follows the second curved surface, the second curved surface having a greater curvature than the first curved surface, wherein the knife is mounted on the knife carriage such that the first curved surface is positioned away from the rotational trajectory of the piercing projections on the peripheral-drive member with a predetermined gap when the peripheral-drive member is most closely positioned to the knife.

In this case, it is preferable that the angle formed by a line tangent to the second curved surface at the cutting edge and the flank is in the range of from 8° to 25°, and that the length of the second curved surface is in the range of from 1 to 5 mm. Further, a microscopic portion of the cutting edge of the knife mounted on the knife carriage may be provided with a finish grinding with one or more finish angles which are somewhat larger than the angle at an extreme edge portion of the cutting edge portion.

In a further preferable embodiment of the peripherally driven veneer lathe according to the present invention, in order to ensure a satisfactory cutting ability, the axis of rotation of the peripheral-drive member with the many piercing projections formed on its periphery is positioned on a line perpendicular to the cutting face and passing at the cutting edge of the knife, when the knife and the peripheral-drive member are most closely positioned to each other.

DETAILED DESCRIPTION OF PREFERRED EMBODIMENTS

The present invention will be hereafter described by way of embodiments shown in FIGS. 1–7. In those figures, members or elements identical or equivalent to those forming the peripherally driven veneer lathe of the type already described with reference to FIGS. 8–13 are referenced by similar numerals for simplicity's sake. As to the knife 7 (17, 27) according to the present invention, there is no particular restrictions in the angle of intersection at a point X of an extended plane of the cutting face 7*a* (17*a*, 27*a*) and the flank 7*b* (17*b*, 27*b*), as long as the angle is not such as to block the mounting of the knife on the knife carriage. However, from the viewpoint of ease of exchange with the conventional knife, i.e., in terms of ease of application in the existing peripherally driven veneer lathe (especially of the type where the sliding base of the knife carriage is fixed), it is preferable to form the intersection angle at the same angle with the sharpness angle β of the conventional knife.

Figure 1:
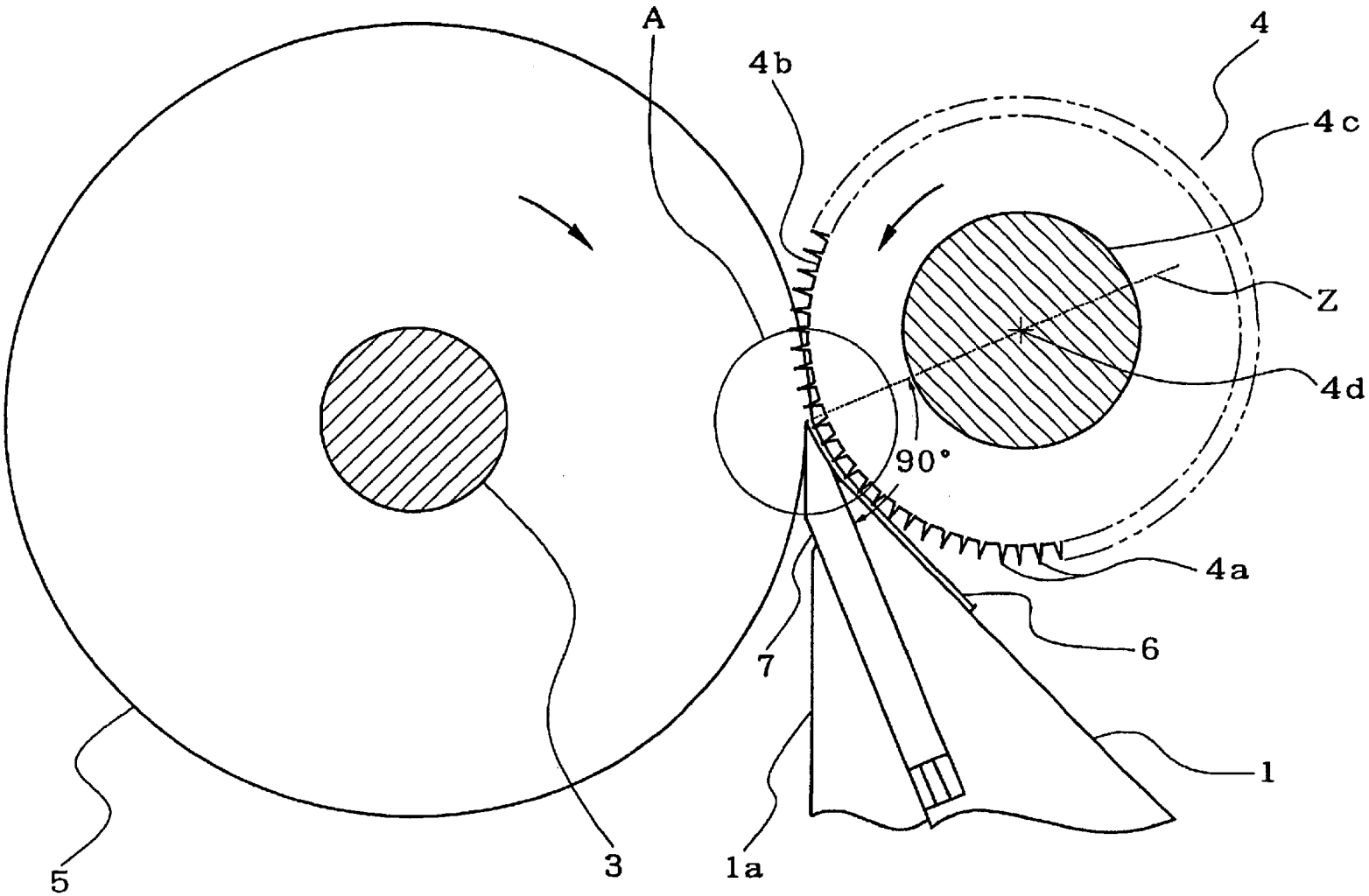
FIG. 1 shows a schematic side elevation of the main portion of an embodiment of the peripherally driven veneer lathe according to the present invention.
Figure 2:
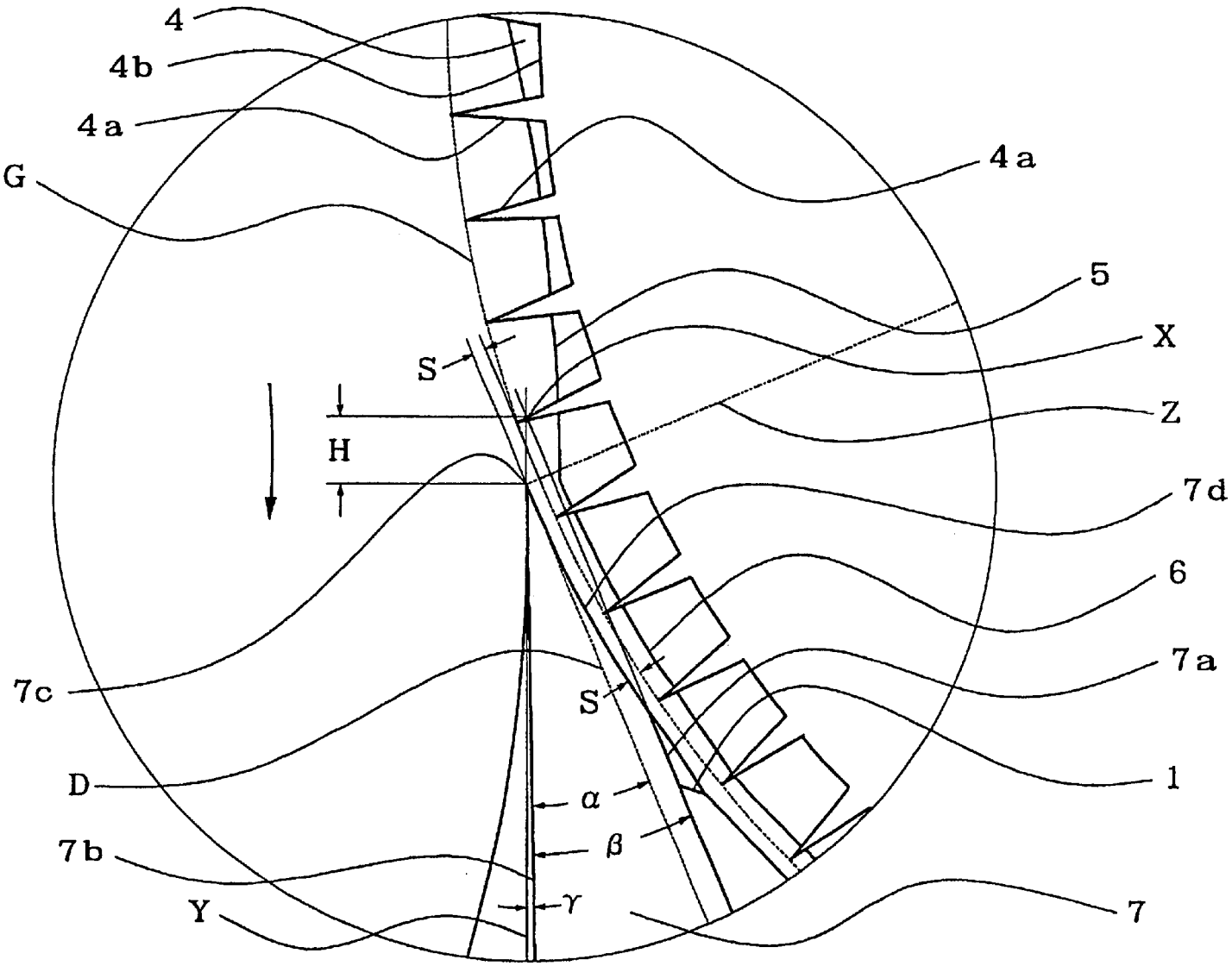
FIG. 2 is a partially enlarged view of the main portion (portion A) of the peripherally driven veneer lathe shown in FIG. 1.
Figure 3:
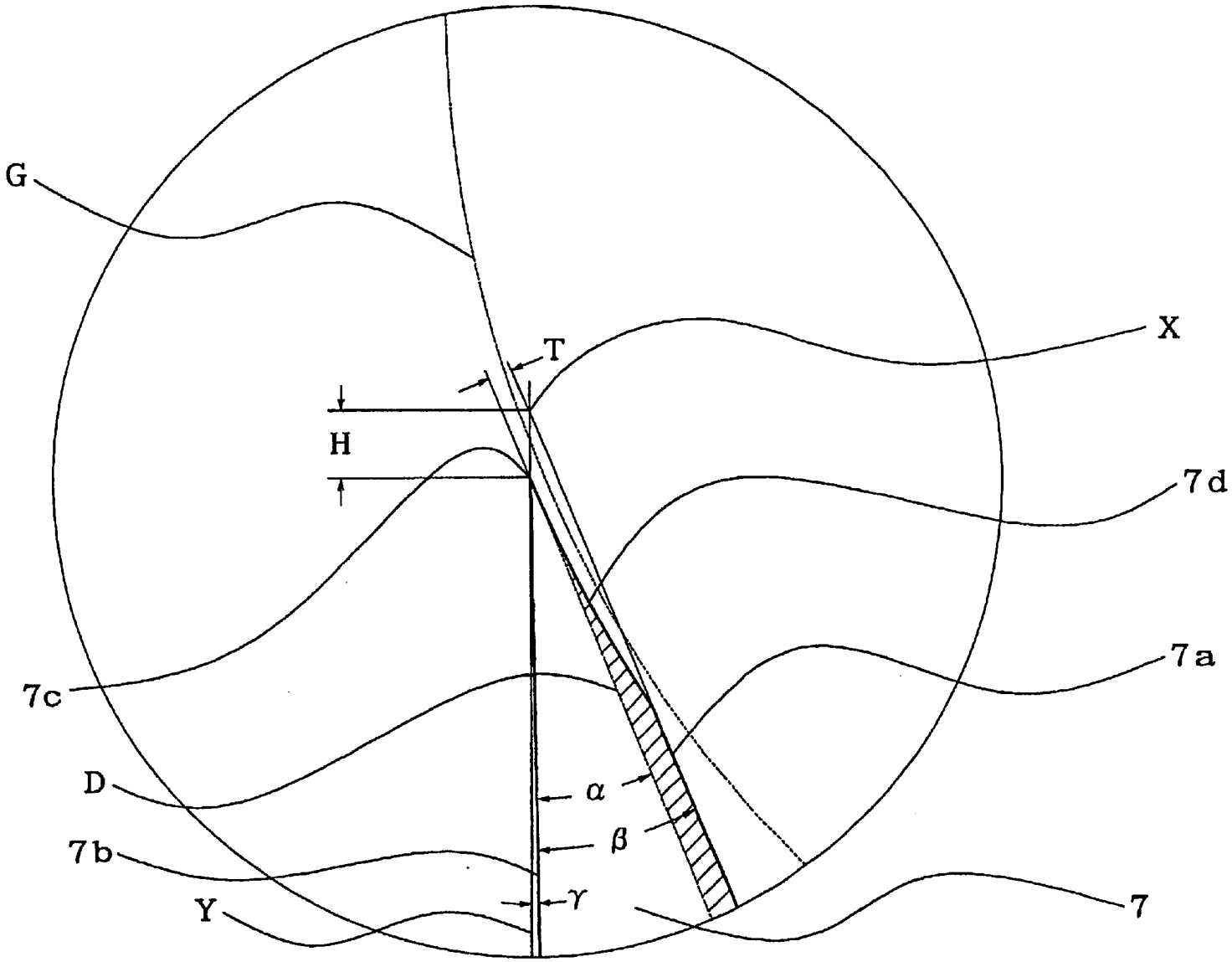
FIG. 3 is a drawing for the explanation of the main portion of the knife shown in FIGS. 1 and 2.
Figure 4:
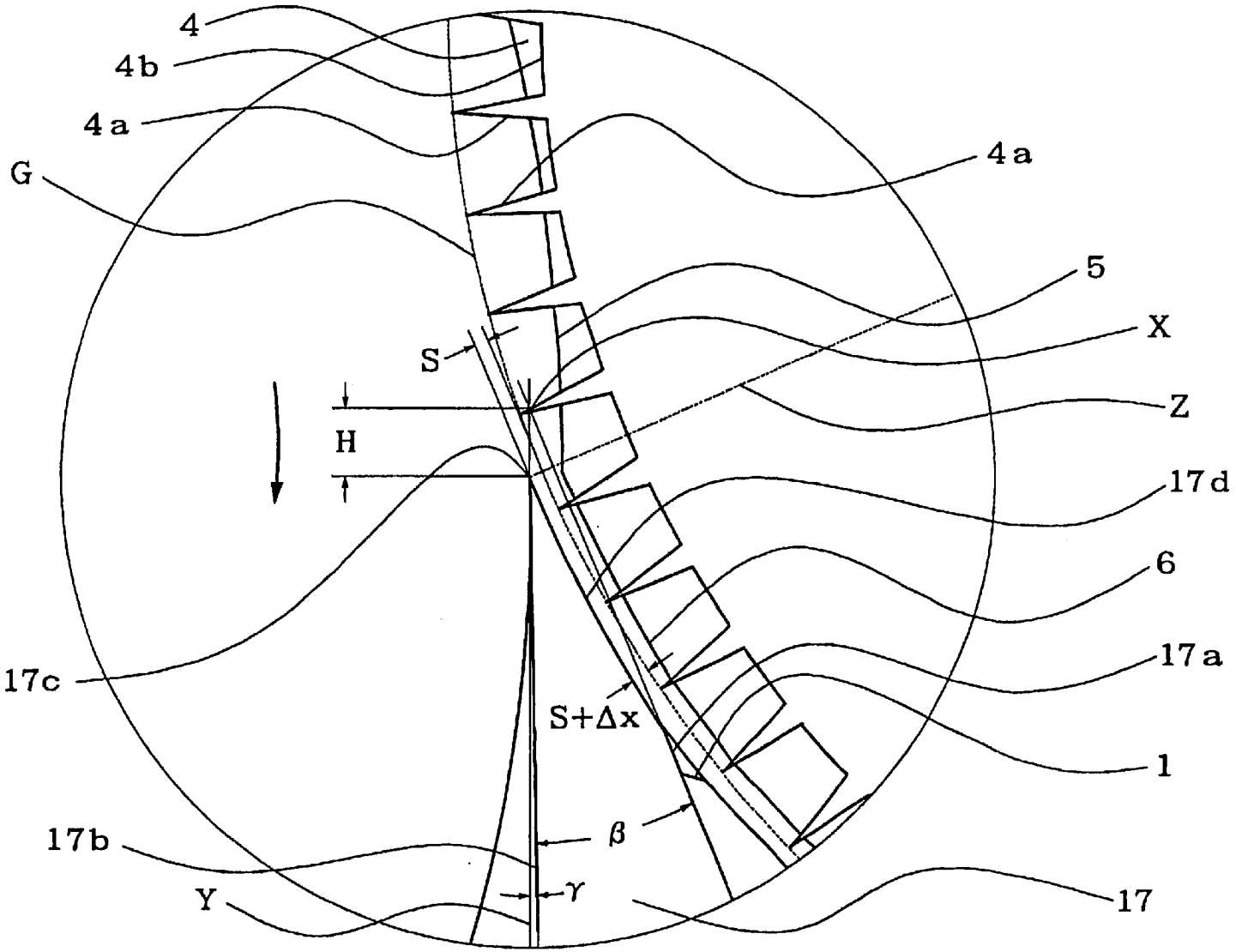
FIG. 4 shows the main portion of another embodiment of the peripherally driven veneer lathe according to the present invention, corresponding to the view of FIG. 2.
Figure 5:
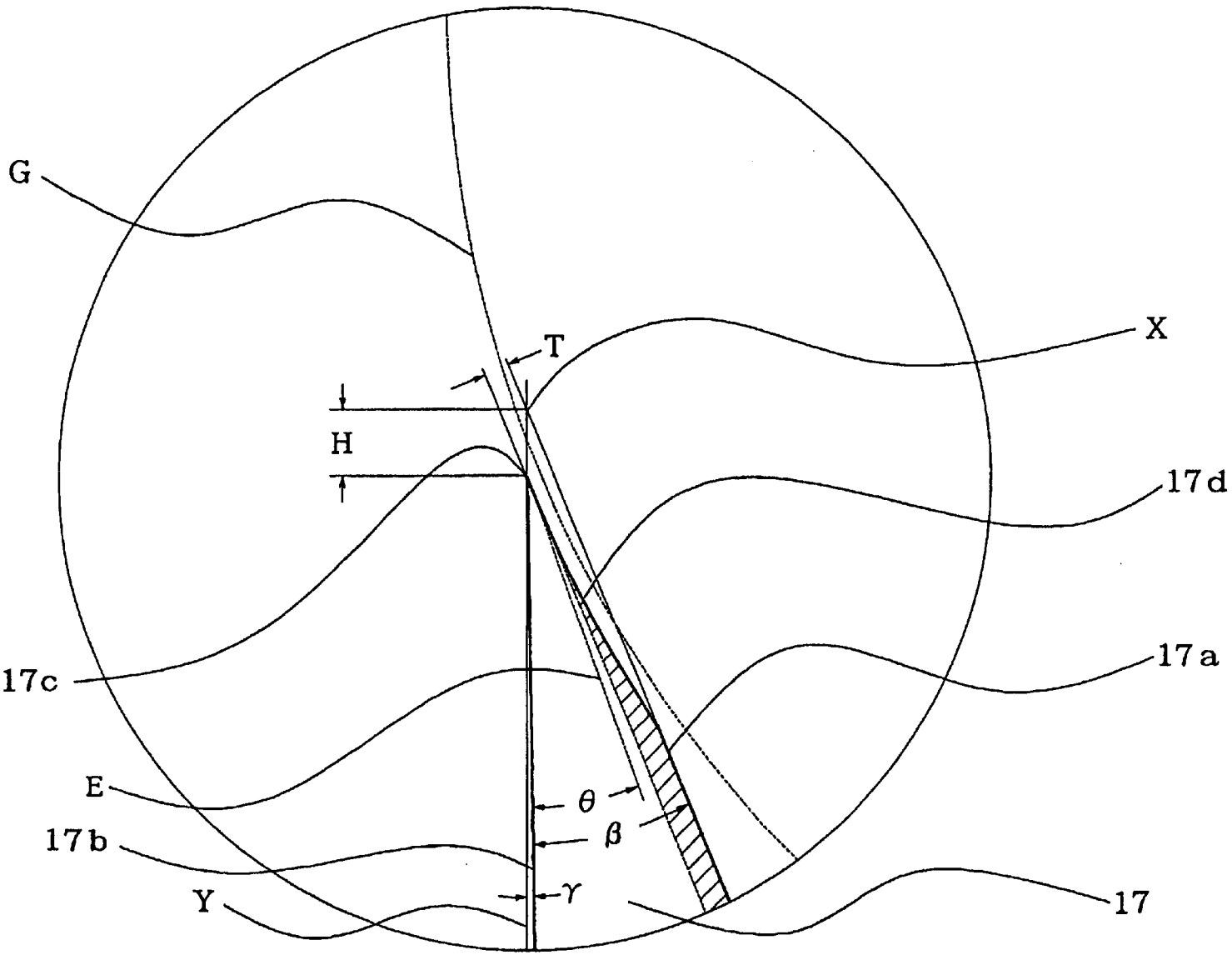
FIG. 5 is a drawing for the explanation of the main portion of the knife shown in FIG. 4.

FIGS. 1–3 shows the main portion of an embodiment of the peripherally driven veneer lathe according to the present invention. As mentioned earlier, the structure of the veneer lathe may be the same as that of the conventional peripherally driven veneer lathe except for the design of the knife 7. In the present embodiment, the knife 7 is disposed such that the cutting edge 7*c* is positioned on the flank side a desired distance H away from the point X of intersection of the extended plane of the cutting face 7*a* and the extended plane of the flank 7*b* toward the downstream of the direction of rotation of the log. The cutting edge 7*c* and the cutting face 7*a* are connected by a connection curved surface 7*d*. The knife 7 of such a shape is mounted on the knife carriage 1 such that the connecting curved face 7*d* is substantially coincident with the concentric arc, which is distanced, with a required gap S, away from the rotation trajectory G of the piercing projections 4*a* (which is generally 120 mm to 150 mm in diameter; the diameter may be reduced down to around 80 mm as required) of the peripheral-drive member 4 when the peripheral-drive member is most closely positioned to the knife 7.

Preferably, the peripheral-drive member 4 is disposed such that the axis 4*d* of the axle 4*c* is positioned on or near the vertical line Z normal to the cutting face 7*a* and passing at the cutting edge 7*c* of the knife 7. The angle α at the extreme edge of the cutting edge portion of the knife 7, i.e., the angle α formed by a tangent D to the connecting curved face 7*d* at the cutting edge and the flank 7*b*, is about the same as the sharpness angle β (18° to 25°) of the conventional knife (see FIGS. 2 and 3).

As is known, the deflection resistance of an object increases or decreases in proportion to the cube of its thickness. For example, if the thickness increases by 10%, the deflection resistance increases by more than 30%, and if the thickness increases by 20%, the deflection resistance increases by more than 70%. In the case of the knife 7 shaped as described above, since its angle α at the extreme edge of the cutting edge portion is about the same as the sharpness angle β of the conventional knife, its cutting ability is about the same as that of the conventional knife. However, in the knife 7, the substantial thickness of the cutting edge portion is greater than the conventional knife by the portion indicated by hatching, as shown in FIG. 3, so that the deflection resistance of the cutting edge portion of the knife 7 is significantly improved. Thus, the deflection of the cutting edge portion of the knife 7 can be significantly reduced as compared with the conventional knife, without undermining the cutting ability.

With the formation of the connecting curved surface 7*d*, the direction of delivery of the veneer 6 is guided to follow the rotation trajectory G of the piercing projections 4*a* of the peripheral-drive member 4 as the log is peeled by the knife 7. Therefore, the veneer can be delivered more smoothly than is possible in the prior art when the veneer is transferred directly onto the knife carriage 1. This is also the case where, as required, a guide member is provided at the tip of the knife carriage having a guide surface substantially coincident with the concentric arc distanced, by a desired gap, away from the rotation trajectory of the piercing projections and where also a bending member is provided between the adjacent drive members so as to be able to forcibly bend the veneer toward the back side (see the conventional examples shown in FIGS. 11 and 12).

The connecting curved surface formed on the cutting face side does not necessarily have to strictly coincide with the concentric arc. For example, in the case of a knife 17 shown in FIGS. 4 and 5, the shape of a connecting curved surface 7*d* located immediately after a cutting edge 17*c* located on the flank side a desired distance H away from a point X of intersection of a cutting face 17*a* and a flank 17*b* toward the downstream of the rotation of the log is not strictly coincident with the concentric arc. Namely, the gap between the rotation trajectory G of the piercing projections 4*a* and the connecting curved surface 17*d* may be S at the cutting edge position but S+Δx near the cutting face. In that case, the angle θ of the extreme edge of the cutting edge portion, i.e., the angle formed by a tangent E to the connecting curved surface 17*d* at the cutting edge and the flank 17*b*, might be smaller than the lower limit value 18° of the sharpness angle β of the conventional knife, but this does not pose any practical problems as long as the angle θ is not excessively small.

More specifically, if in the knife 17 the angle θ of the extreme edge of the cutting edge portion is smaller than the lower limit value 18° of the sharpness angle β of the conventional knife, the deflection resistance of the extreme edge of the cutting edge portion drops below that of the conventional knife. But, as will be seen from FIG. 5, when seen as a whole, the cutting edge portion is in real terms still thicker than the conventional knife by the portion indicated by the hatching. Therefore, even if the angle θ is made somewhat smaller, the deflection resistance of the cutting edge portion as a whole can be maintained equal to or more than that of the conventional knife and there will be no practical problems. The important thing is that the curved surface formed on the cutting face side is substantially coincident with the concentric arc, which is positioned away from the rotation trajectory of the piercing projections by a desired gap.

Experiments have shown that, as compared with a conventional knife with a lower limit value 18° of the sharpness angle β, no difference at all was observed in terms of problems caused by the deflection of the cutting edge portion when the log is peeled within a range of sharpness angles less than 1° below the lower limit value 18° of the conventional knife. Likewise, hardly any difference in terms of problems caused by the deflection of the cutting edge portion was recognized in a range of 1° to less than 3° below the lower limit value 18°. Thus, the sharpness angle of these values can be put to practical use without problem. Even in a range 3° to 5° below the lower limit value 18°, no problem was observed for the peeling of a soft log; indeed, whereas the conventional knife tended to produce a minute surface roughening on the veneer when a relatively soft log is peeled, the knife with such a sharp cutting edge as the one mentioned above tended to produce a veneer with less of the minute surface roughening, thus indicating an improvement in the cutting ability of the knife with a smaller sharpness angle with respect to a soft log.

It should be noted, however, that the deflection resistance and the cutting ability are not the only properties required of a knife. For example, a compression resistance (buckling resistance), a fracture resistance and so on are also important against particularly hard portions such as a knot or hardened resin. When a log with such a particularly hard portion is to be peeled, it is preferable not to make the angle θ (and angle α) too small, as in the case of the conventional knife.

The thickness T (in a direction perpendicular to the cutting face) by which the cutting edge portion of the knife is made thicker than the conventional knife is closely related to the distance H. Namely, the thickness T increases in proportion to the distance H, so that as the distance H increases, the thickness T increases proportionately, and as the distance H decreases, the thickness T decreases proportionately. Thus if one is fixed, the other is fixed, too. Since the thickness T is directly related to the degree of improvement in the deflection resistance of the knife, more attention should be paid to the thickness T when setting the values of the distance H and the thickness T. For example, the thickness of the knife as a whole may be similar to the prior art (from 10 mm to 16 mm; the majority of practical examples employ 16 mm), and the distance H may be properly set within that range of thickness, or the thickness of the knife as a whole may be made thicker as much as desired than those of the prior art. In the latter case, if the thickness of the knife as a whole is made twice as thick as those of the prior art and the cutting edge is provided at a position corresponding to half that twice-the-prior-art thickness, such an arrangement can be practiced as long as the knife can be mounted on the knife carriage. However, from the viewpoints of ease of machining including re-polishing, and ease of handling including weight reduction, it is not beneficial to make the thickness excessively large. As a rule of thumb, a thickness ranging from 1 mm to 4 mm (preferably from 2 mm to 3 mm) is recommended for increasing the deflection resistance for practical purposes.

Figure 6:
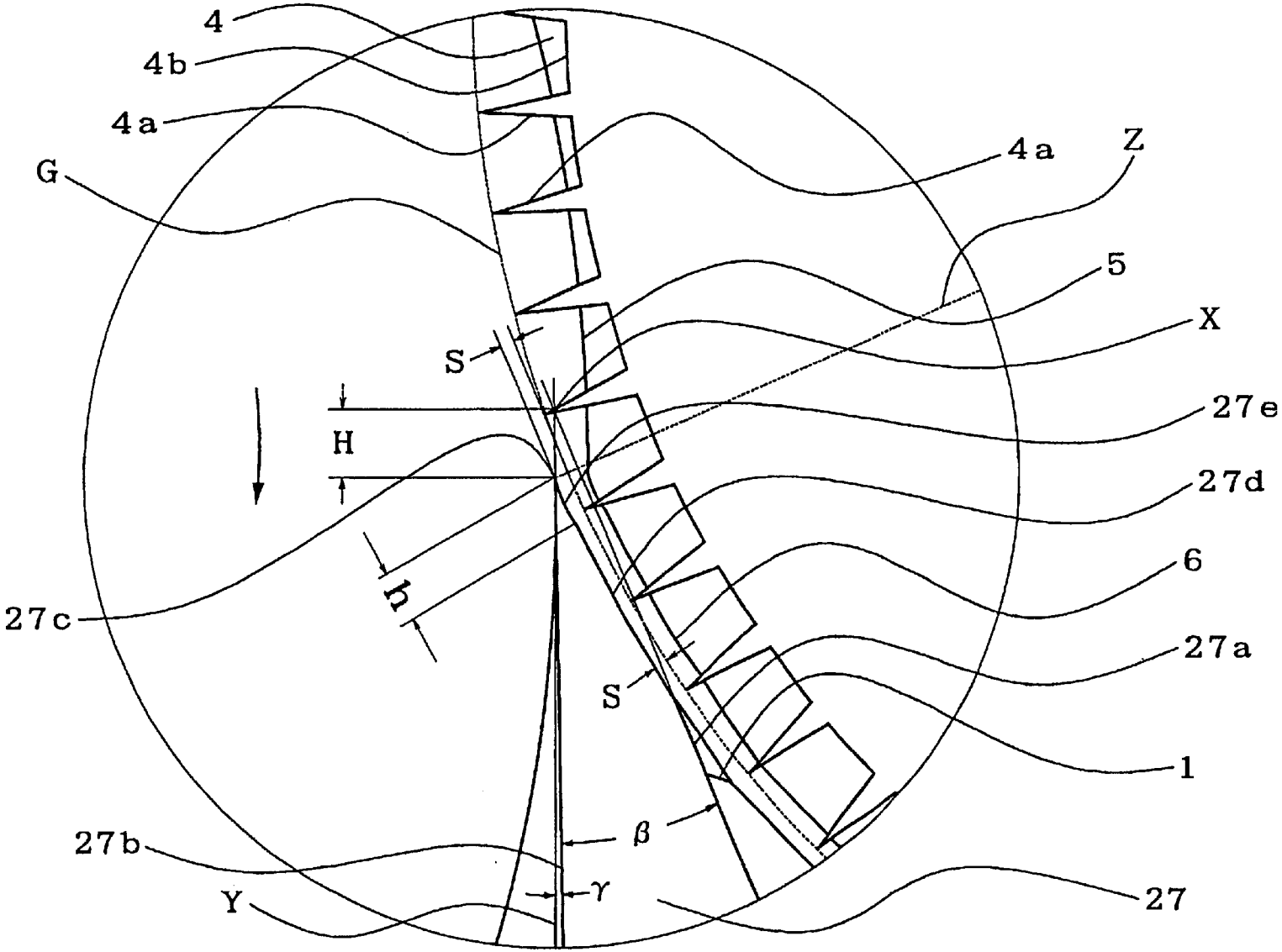
FIG. 6 shows the main portion of yet another embodiment of the peripherally driven veneer lathe according to the present invention, corresponding to the view of FIG. 2.
Figure 7:
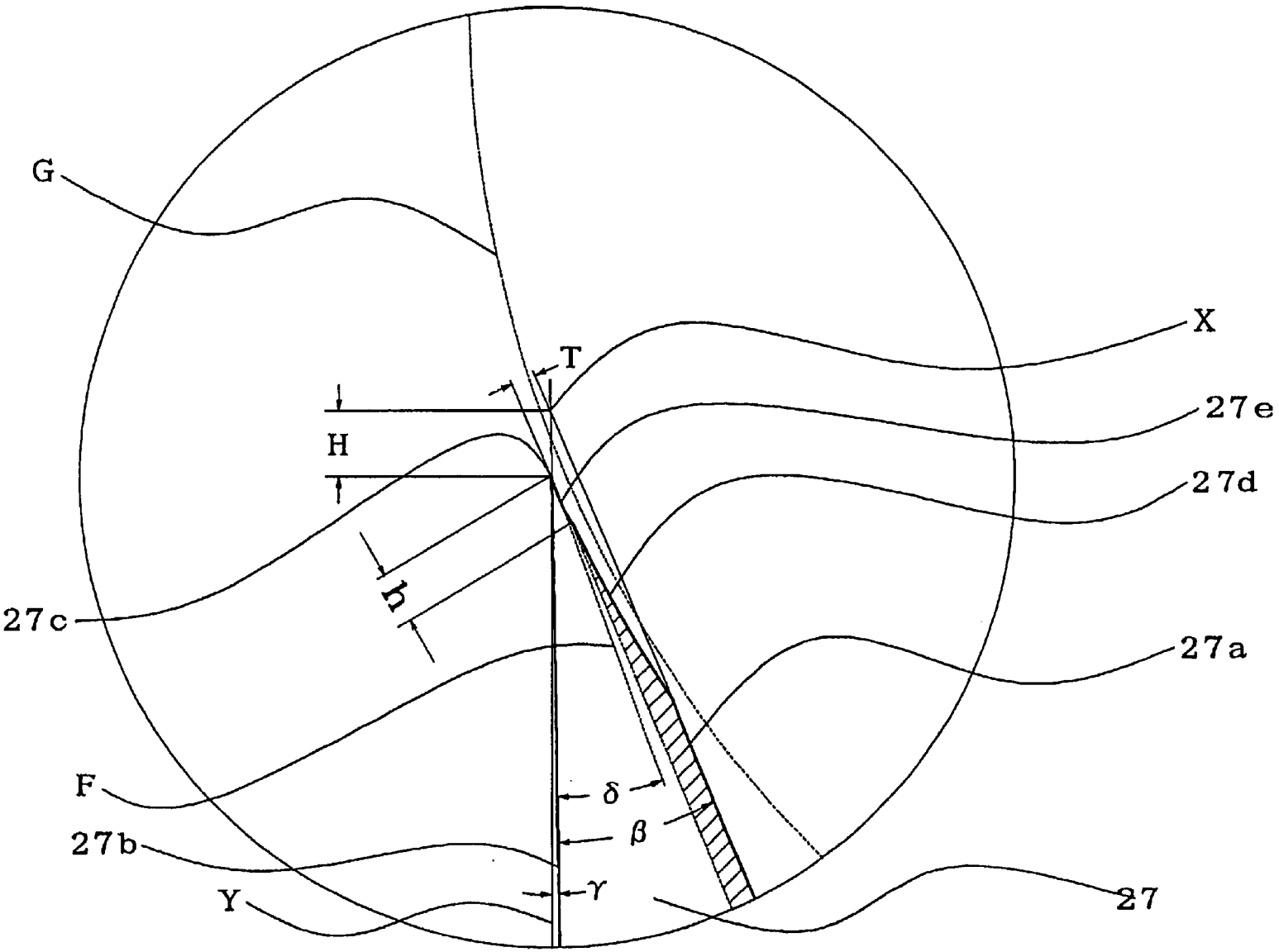
FIG. 7 is a drawing for the explanation of the main portion of the knife shown in FIG. 6.
Figure 8:
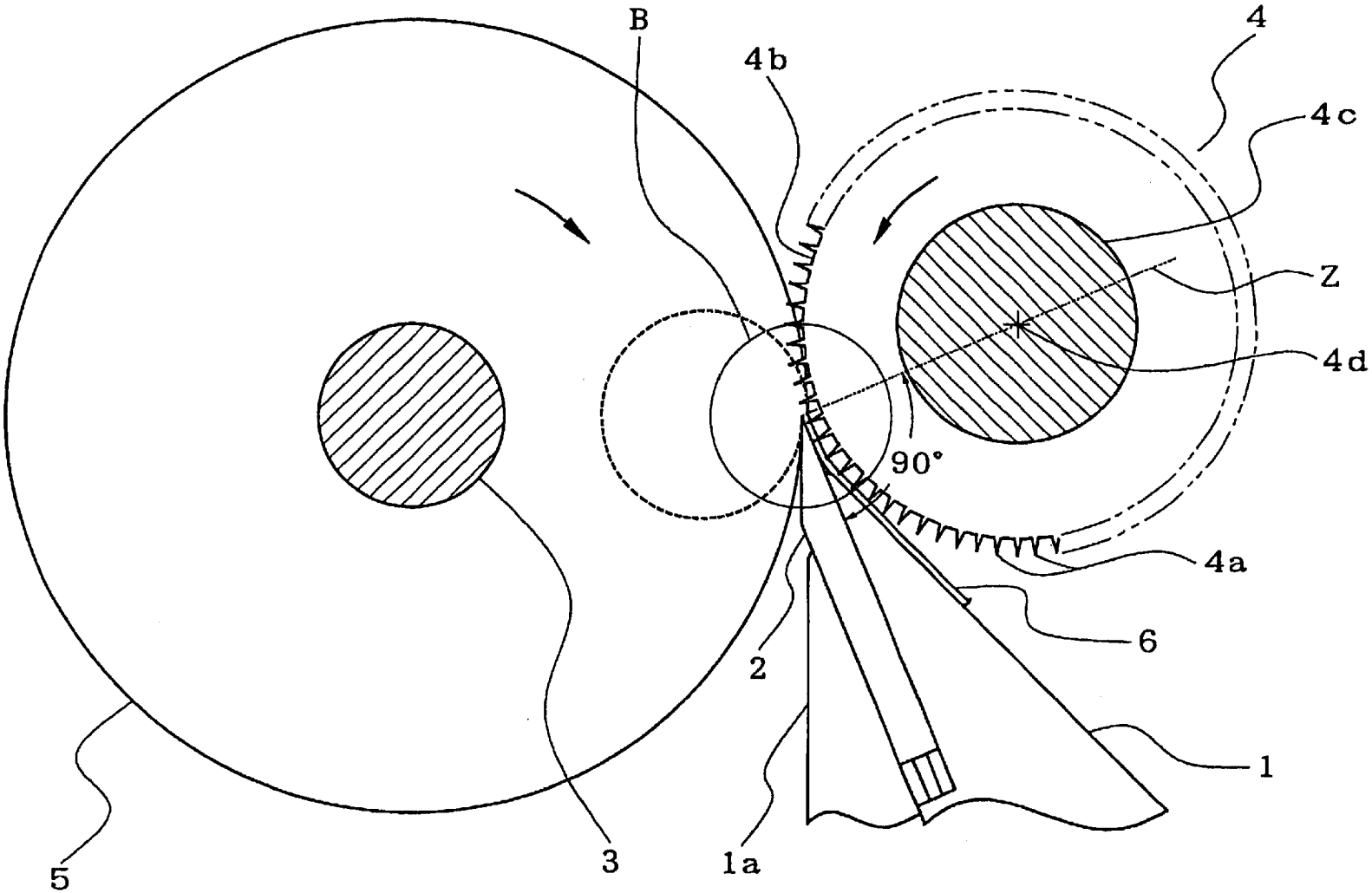
FIG. 8 shows a schematic side elevation of the main portion of an example of a peripherally driven veneer lathe according to the prior art.
Figure 9:
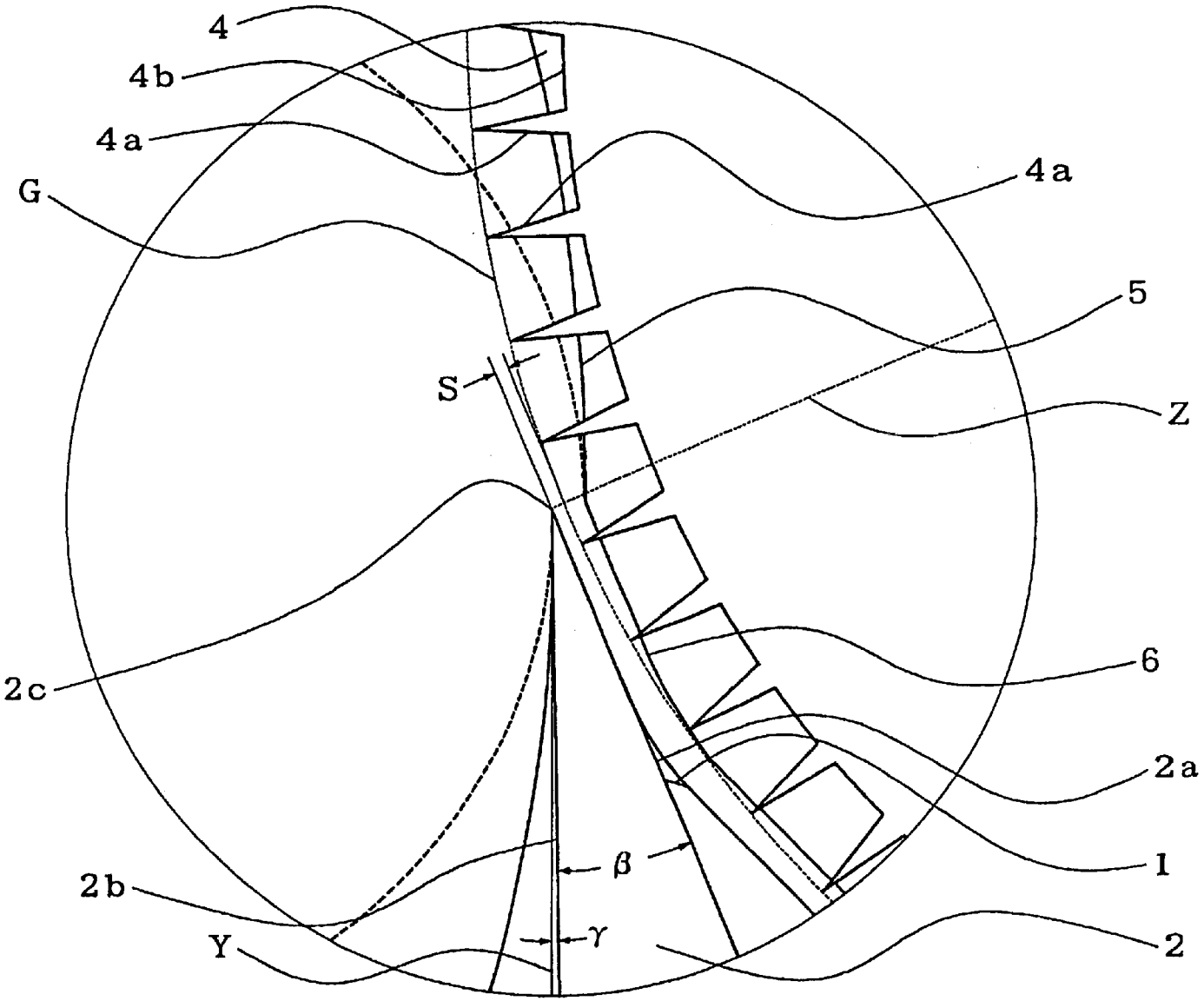
FIG. 9 is a partially enlarged view of the main portion (portion B) of the peripherally driven veneer lathe shown in FIG. 8.
Figure 10:
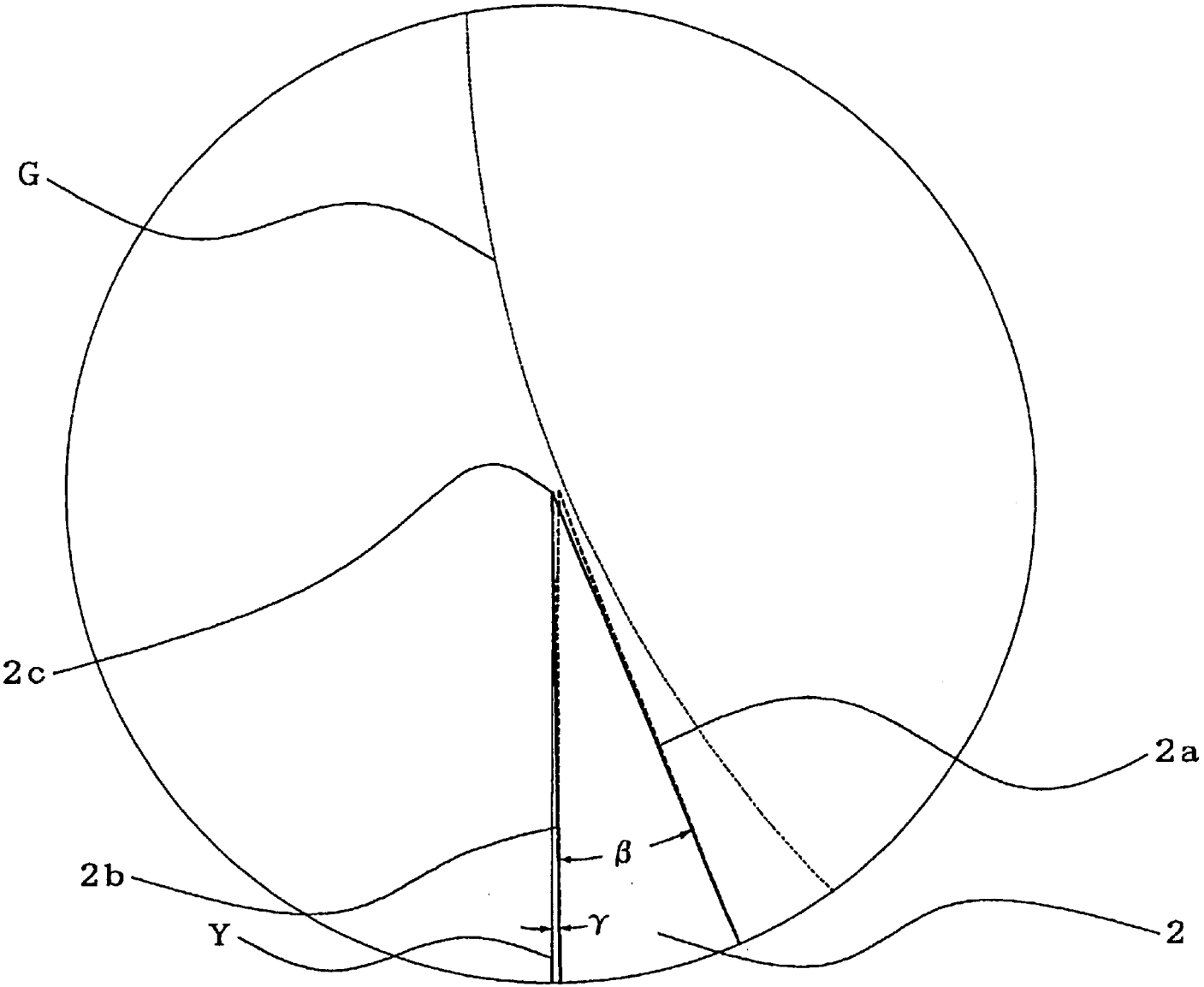
FIG. 10 is a drawing for the explanation of the main portion of the knife shown in FIGS. 8 and 9.
Figure 11:
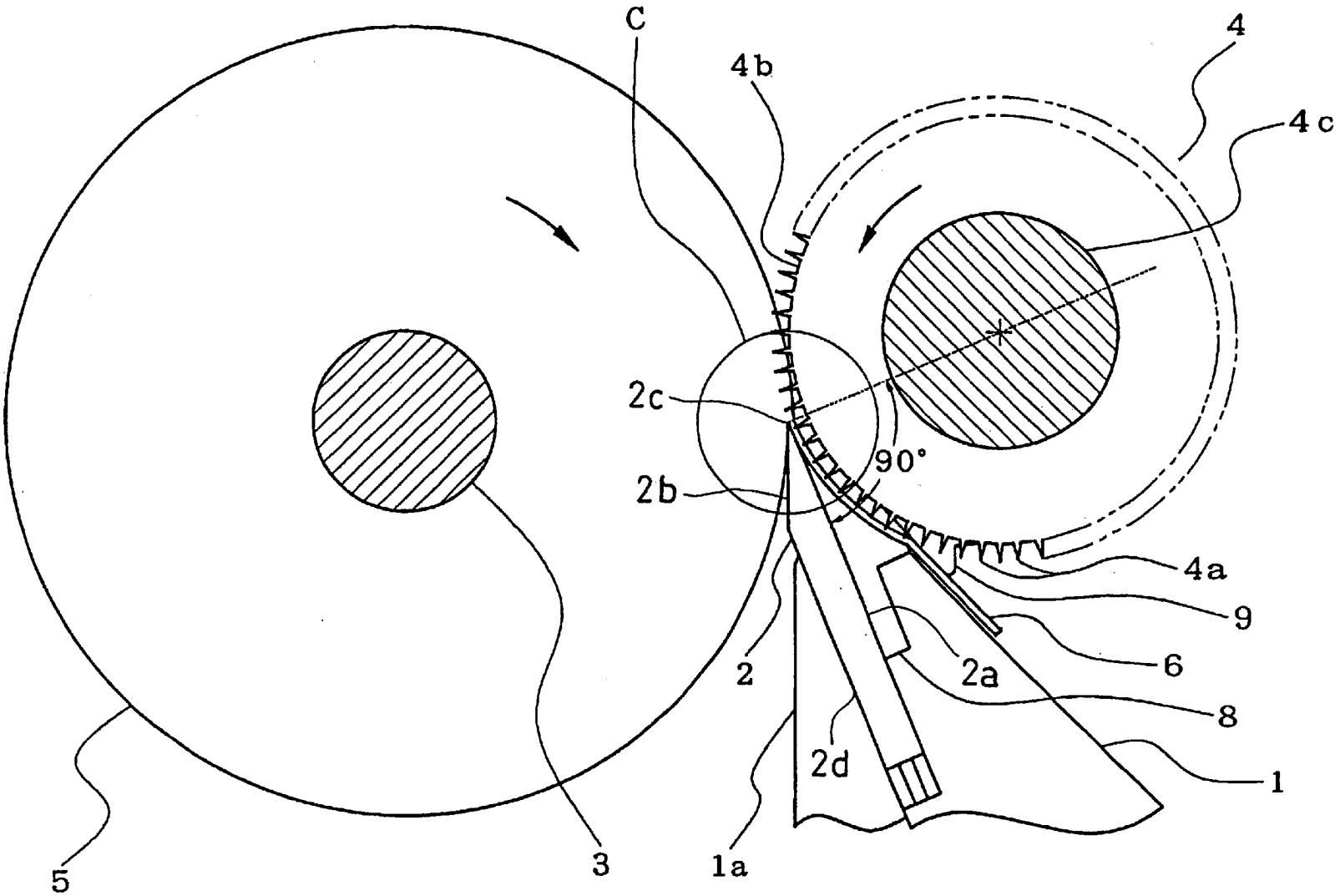
FIG. 11 shows a schematic side elevation of the main portion of another example of a peripherally driven veneer lathe according to the prior art.
Figure 12:
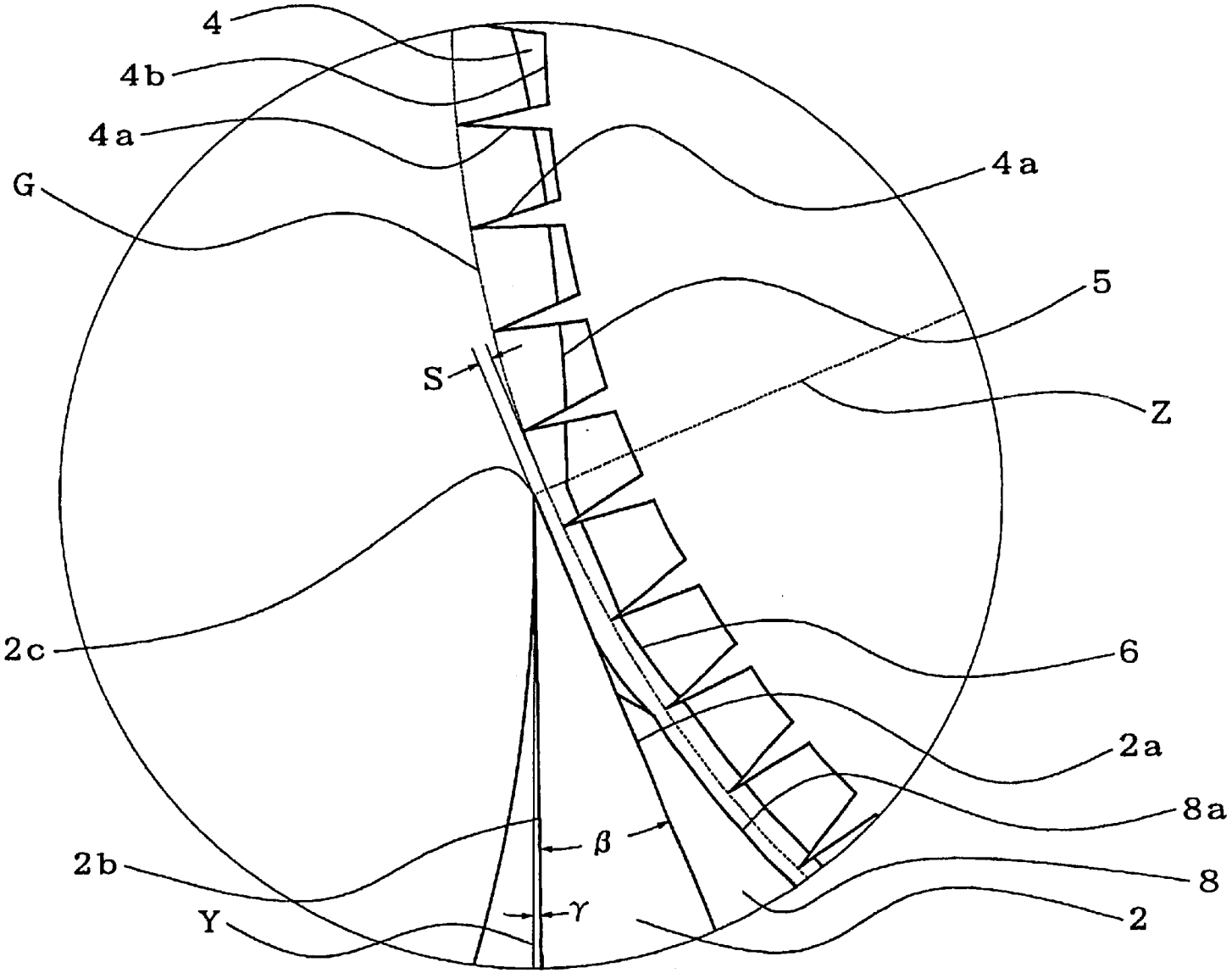
FIG. 12 is a partially enlarged view of the main portion (portion C) of the peripherally driven veneer lathe shown in FIG. 11.
Figure 13:
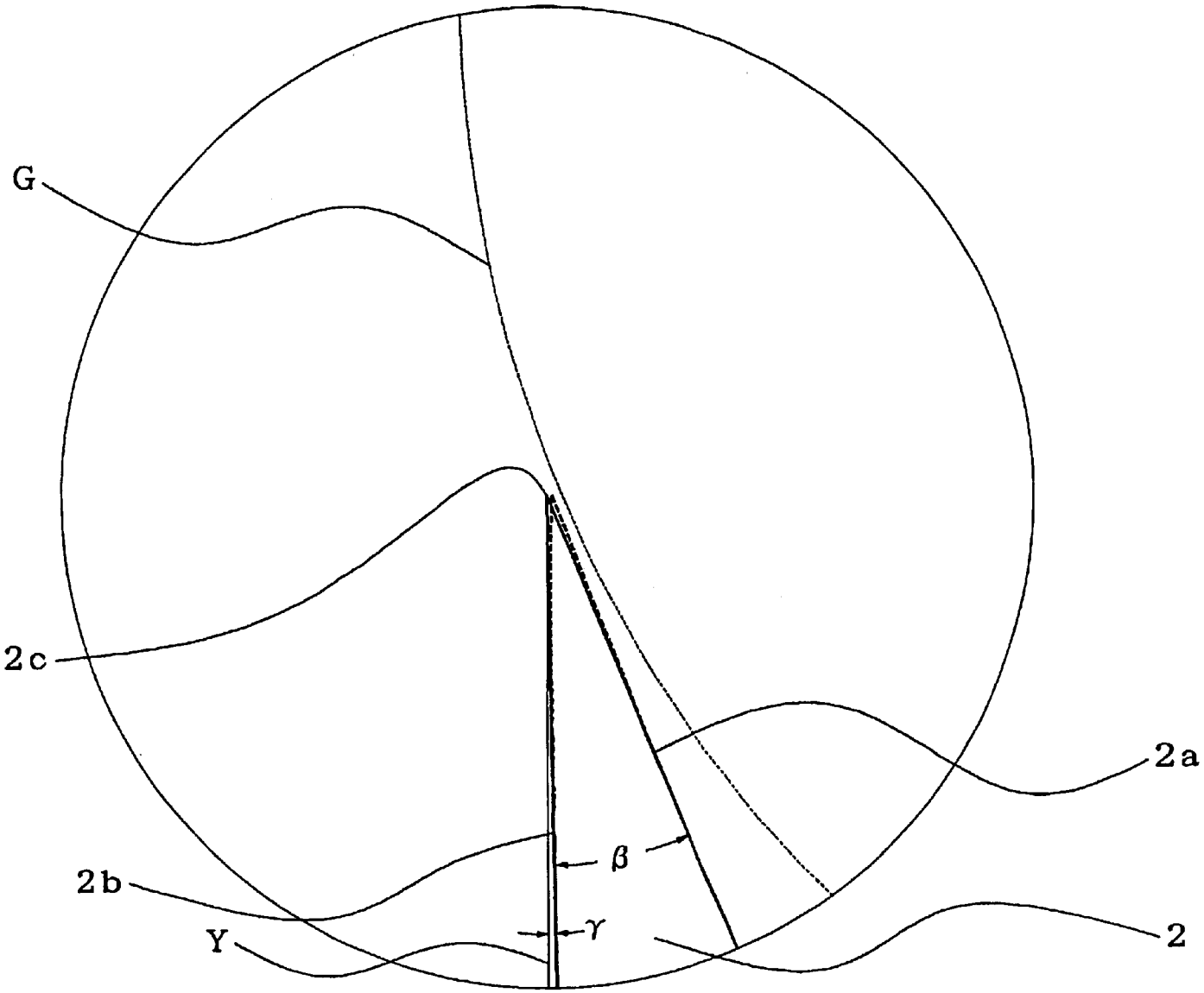
FIG. 13 is a drawing for the explanation of the main portion of the knife shown in FIGS. 11 and 12.

FIGS. 6 and 7 show the main portion of the peripherally driven veneer lathe according to the present invention using another example of the knife. In this example, a knife 27 is disposed such that a cutting edge 27*c* is positioned on the flank side a desired distance H away from a point X of intersection of an extended plane of a cutting face 27*a* and an extended plane of a flank 27*b* toward the downstream of the direction of rotation of the log. The knife 27 includes a connecting curved surface immediately behind the cutting edge 27*c* on the cutting face side. The connecting curved surface is formed as a two-step curved surface, including a second curved surface 27*e* continuous with the cutting edge 27*c* and a first curved surface 27*d* continuous with the second curved surface 27*e*.

As shown in FIG. 7, the knife 27 is mounted on the knife carriage 1 such that the first curved surface 27*d* is substantially coincident with the concentric arc, which is distanced, by a required gap S, away from the rotation trajectory G of the piercing projections 4*a* of the peripheral-drive member 4, when the peripherally driven member 4 is most closely positioned to the knife 27. Though not required, it is preferable that the second curved surface 27*e* has a somewhat larger curvature than the first curved surface 27*d*. Further, the second curved surface 27*e* is formed such that, when the knife 27 is mounted on the knife carriage 1, an angle δ formed by a tangent F to the second curved surface 27*e* at the cutting edge and the flank 27*b*, i.e., the angle at the extreme edge of the cutting edge portion, is within a range which is somewhat below the range of the sharpness angle of the conventional knife, which is between less than the upper-limit value 25° (preferably 23° or less, from the viewpoint of overall cutting ability, taking into account the variety of nature of the log to be peeled) and the lower-limit value 18°.

The knife 27 of such a shape can be thought of as the knife 7 shown in FIGS. 1–3 to which the second curved surface 27*e* has been added, for the first curved surface 27*d* of the knife 27 can be superposed on the curved surface 7*d* of the knife 7.

The knife 27 thus shaped can not only facilitate the smooth delivery of the veneer 6, as in the case of the knives 7 and 17 described with reference to FIGS. 1–5, but it provides a cutting ability which is equal to or better than that of the knives 7 and 17, because of the fact that the second curved surface 27*e* has a somewhat larger curvature (i.e., greater degree of curvature) than the first curved surface 27*d*, and that the angle δ at the extreme edge of the cutting edge portion is within a range which is somewhat below the range of the sharpness angle of the conventional knife between less than the upper limit value 25° and the lower limit value 18°. As shown in FIG. 7, since the cutting edge portion is made thicker than that of the conventional knife by the portion indicated by the hatching, the deflection resistance of the cutting edge portion is significantly increased as compared with the conventional knife. Thus, the knife 27 has a cutting ability which is equal to or better than the conventional knife while significantly reducing the amount of deflection in the cutting edge portion.

While the above-mentioned angle δ can be reduced down to at least about the angle θ which was described in connection with the knives 7 and 17 and still the knife can be put to practical use, preferably the angle δ should not be reduced too much when a log with a particularly hard portion is to be peeled. Likewise, the thickness T, by which the thickness of the knife as a whole becomes greater than that of the conventional knife, should not be too large. The thickness T should be, as a rule of thumb, in the range of about 1 mm to 4 mm (preferably from 2 mm to 3 mm) for increasing the deflection resistance for practical purposes.

If the length h of the second curved surface 27*e* is too short, the improvement of the cutting ability brought about by the reduction in the angle δ tends not to manifest itself. On the other hand, if the length h is too long, this reduces the deflection resistance of the cutting edge portion. Accordingly, there is a desirable range of the tangential length h. Experiments have shown that the desirable length of the length h was in the range from 1 mm to 5 mm. This range, however, should not be taken in a limiting sense, for a length smaller than 1 mm does not necessarily cancel out the improvement in the cutting ability, nor does the length of 5 mm or more make it impossible to maintain the deflection resistance of the cutting edge portion equal to or better than that of the conventional knife.

In the knife 27, there are no restrictions as to the relationship between the angle β of intersection of the extended plane of the cutting face 27*a* and the extended plane of the flank 27*b*, and the angle δ at the extreme edge of the cutting edge portion. For example, the intersection angle β may be set at the upper-limit value 25° of the sharpness angle of the conventional knife, while the angle δ of the extreme edge of the cutting edge portion may be around 22°, with which a generally excellent cutting ability can be obtained. Alternatively, the intersection angle β may be 19° which is near the lower-limit value of the sharpness angle of the conventional knife, while setting the angle δ of the extreme edge of the cutting edge portion at around 17°, which is suitable for the peeling of a soft log. While in these examples the difference between the intersection angle β and the angle δ of the extreme edge of the cutting edge portion is relatively small, it is also possible to use a combination of other angles where the difference is positively increased, such as, e.g., setting the angle β at the upper-limit value 25° of the sharpness angle of the conventional knife while setting the angle δ of the extreme edge of the cutting edge portion at the lower-limit value 18° of the sharpness angle of the conventional knife. At any rate, it is preferable, as a rule, to maintain the relationship β>δ from the viewpoint of striking a balance between the strengthening of the deflection resistance of the cutting edge portion and the improvement of the cutting ability.

The reason why the angle formed by the cutting face and the flank in each example of the knife according to the present invention is preferably made similar to that of the conventional knife is for the sake of ease of replacement with the knife in the existing peripherally driven veneer lathe. However, the angle of intersection of the cutting face and the flank in the present invention may be different from that of the conventional knives. In that case, a wedge shaped washer may be separately provided as required for angle adjustment purposes so that the knife can be applied in the existing peripherally driven veneer lathe. While in the above-described examples, the flank was a simple flat surface, it may be provided with a minute depression if necessary.

Further, while in the illustrated embodiments the connecting curved surface of the knife according to the present invention as a rule follows the arc, as shown, this is not to be taken in a limiting sense. Namely, since the connecting curved surface in each example has a shallow curvature and a short length, there would not be such a difference as to produce any serious practical problem even if the connecting surface is formed to coincide with, e.g., a part of an ellipse. Such non-circular curved surfaces, including the curved surface coincident with a part of an ellipse, can be formed by a grinding process not much different from the process of forming a curved surface that follows an arc, i.e., by properly tilting the axis of the grinding wheel, for example.

When the knife according to the present invention is formed into the required shape by mechanical grinding, it is inevitable that burrs or shavings remain on the cutting edge of the knife, and usually those shavings must be removed by hand in a finishing process. Accordingly, while not illustrated, the cutting edge may be ground or polished for purposes of finishing as well as removing the shavings, as known in the art. Such finish grinding can be sufficiently performed by grinding the cutting edge portion, mainly on the flank side, with one or more finish angles somewhat larger than the angle of the extreme edge of the cutting edge portion. However, in order not to unnecessarily lose the cutting ability of the knife prior to the finish grinding, the sharpness of the cutting edge portion should preferably be maintained at the same level as that prior to the finish grinding. Therefore, it is preferable to make the length of finish grinding less than as known in the art (200 μm to 700 μm), and to provide a rather shorter length of finish grinding (several tens of μm to 400 μm, preferably several tens of μm to 300 μm).

As mentioned above, movably mounting the peripheral-drive member relative to the knife carriage is known in the art. For example, when the log is held and turned by using the known multiple-spindle arrangement in which two or more spindles are used, there are cases where the log can be peeled without problem even if the peripheral-drive member is disengaged as long as the outer, relatively thick spindle is engaged with the log. In another example, the driving backup rolls are additionally provided to supply motive power through the periphery of the log. Therefore, the peripherally driven veneer lathe according to the present invention may be provided with a forcible transport mechanism for forcibly moving the peripheral-drive member away from the center of the log even further than that in the above known example. In this way, the engagement of the peripheral-drive member with the log can be intentionally and temporarily released whenever desired.

Thus, in the peripherally driven veneer lathe in accordance with the present invention, the cutting edge and the cutting face are connected by a connecting curved surface. This design provides the cutting edge portion of the knife with an increased level of deflection resistance and provides an improved cutting ability while maintaining the log drive functions and the cutting ability of the conventional peripherally driven veneer lathe. The design according to the invention requires no change in the positional relationships among the constituent members or elements of the conventional peripherally driven veneer lathe. The present invention also allows the veneer to be more smoothly delivered. Accordingly, the present invention can enhance the usefulness of the peripherally driven veneer lathe.

What is claimed is:

1. A peripherally driven veneer lathe comprising a knife, a knife carriage on which the knife is mounted, a peripheral-drive member, and a member for supporting a log, the peripheral-drive member having a plurality of drive members disposed at intervals in an axial direction and substantially parallel to the cutting edge of the knife, each drive member having formed a number of piercing projections on its periphery, wherein the cutting edge of the knife is positioned on a side of a flank a predetermined distance away from a point of intersection of an extended plane of the cutting face and an extended plane of the flank toward the downstream of the direction of rotation of the log, the cutting edge being connected to the cutting face via a connecting curved surface, wherein the knife is mounted on the knife carriage such that the connecting curved surface is positioned away from the trajectory of rotation of the piercing projections with a predetermined gap when the peripheral-drive member is most closely positioned to the knife.

2. A peripherally driven veneer lathe according to claim 1, wherein the connecting curved surface of the knife is formed such that the angle formed by a line tangent to the connecting curved surface at the cutting edge and the flank is substantially equal to the angle of intersection of the extended plane of the cutting face and the extended plane of the flank.

3. A peripherally driven veneer lathe according to claim 1 or 2, wherein the connecting curved surface that follows the second curved surface, the second curved surface having a slightly larger curvature than the first curved surface, wherein the knife is mounted on the knife carriage such that the first curved surface is positioned away from the trajectory of rotation of the piercing project ions with a predetermined gap when the peripheral-drive member is most closely positioned to the knife.

4. A peripherally driven veneer lathe according to claim 3, wherein second curved surface has a length in the range of from 1 mm to 5 mm.

5. A peripherally driven veneer lathe according to claim 1 or 2, wherein a microscopic portion of the cutting edge of the knife is provided with a finish-grinding with one or more finish angles that are somewhat larger than the angle at an extreme edge portion of the cutting edge.

6. A peripherally driven veneer lathe according to claim 1 or 2, wherein the axis of an angle of each of the driven members, with the many piercing projections formed on the periphery thereof, is positioned on a line perpendicular to the cutting face and passing at the cutting edge of the knife when the knife and the peripheral drive member are most closely positioned to each other.

* * * * *